United States Patent [19]

Lindgren

[11] 4,064,637

[45] Dec. 27, 1977

[54] CYLINDER DRYER FOR PAPER MACHINES

[75] Inventor: Stig Rune Lindgren, Vaxjo, Sweden

[73] Assignee: AB Svenska Flaktfabriken, Nacka, Sweden

[21] Appl. No.: 667,853

[22] Filed: Mar. 18, 1976

[30] Foreign Application Priority Data

Mar. 19, 1975 Sweden ..... 7503134

[51] Int. Cl.[2] ..... F26B 11/02

[52] U.S. Cl. ..... 34/122; 34/155; 34/160

[58] Field of Search ..... 34/114, 129, 119–124, 34/148, 151, 152, 155–157, 159–161

[56] References Cited

U.S. PATENT DOCUMENTS

| | | | |
|---|---|---|---|
| Re. 25,358 | 3/1963 | Underhay et al. | 34/160 |
| 2,174,744 | 10/1939 | Hill | 34/122 |
| 2,197,463 | 4/1940 | Bradner | 34/122 |
| 2,955,969 | 10/1960 | Runton | 34/161 |
| 3,085,347 | 4/1963 | Justus | 34/122 |
| 3,230,636 | 1/1966 | Daane | 34/122 |
| 3,284,920 | 11/1966 | Hayrinen et al. | 34/122 |
| 3,377,056 | 4/1968 | Boye | 34/122 |
| 3,874,997 | 4/1975 | Kankaanpaa | 34/159 |
| 3,891,500 | 6/1975 | Kankaanpaa | 34/155 |

FOREIGN PATENT DOCUMENTS

| | | | |
|---|---|---|---|
| 396,815 | 1/1966 | Switzerland | 34/160 |

*Primary Examiner*—John J. Camby
*Assistant Examiner*—Henry C. Yuen
*Attorney, Agent, or Firm*—Flynn & Frishauf

[57] ABSTRACT

A cylinder dryer for drying wet paper sheet material comprises a plurality of heated cylinders arranged at two levels, the wet paper sheet during the drying process travelling in loops up and down around the cylinders. At least some of the cylinders are provided with hoods, the hoods of at least the upper level heated cylinders having extended wing members which have surfaces facing the wet sheet which project substantially parallel and in close proximity to the portions of the wet sheet that travel unsupported between alternate heated cylinders. The surfaces of the extended wing members have orifices for blowing streams of hot air substantially parallel to the sheet in and opposite to its direction of travel for stabilizing the sheet. The hood, in portions other than the extended wing portions, has orifices for blowing air toward the sheet for drying same.

14 Claims, 6 Drawing Figures

Fig. 1
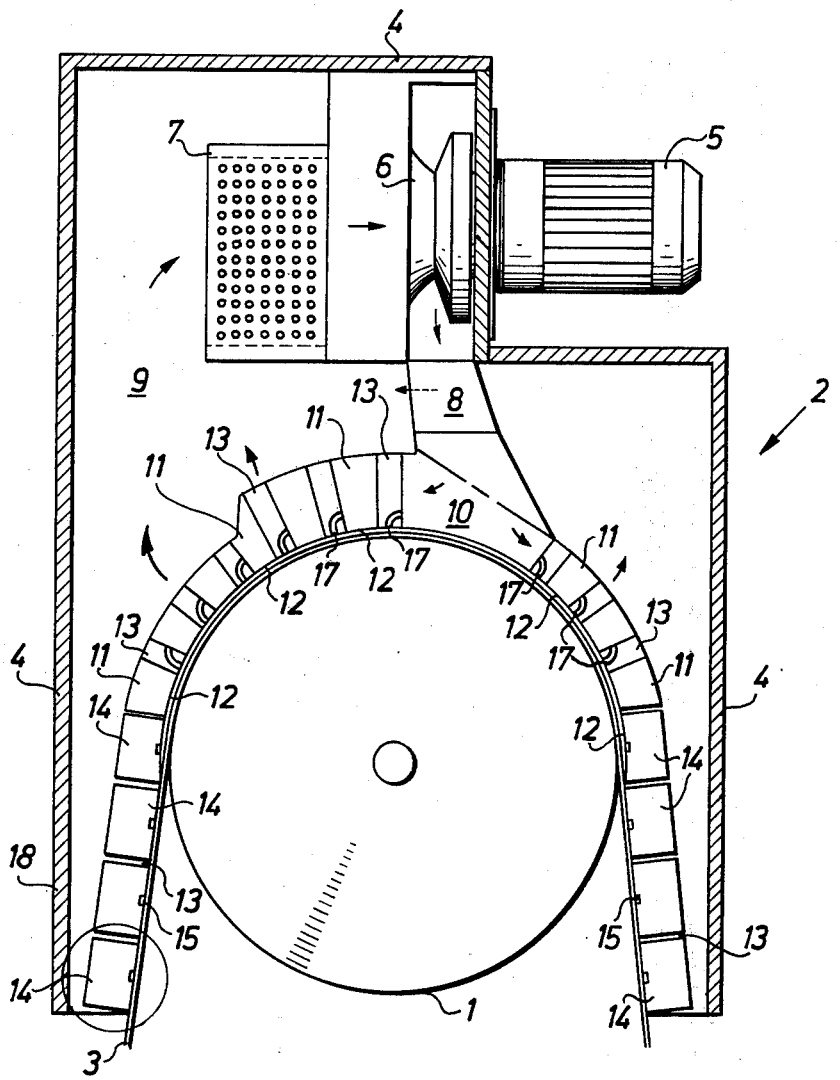
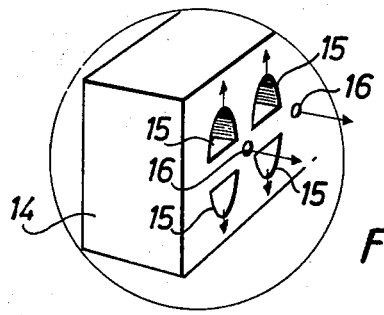
Fig. 1a

CYLINDER DRYER FOR PAPER MACHINES

The present invention relates to a cylinder dryer to be incorporated into the first part of the dry end of a paper machine, the said dryer comprising a plurality of heated cylinders that are arranged at two mainly parallel levels, the sheet during the drying process passing in loops up and down over the cylinders, at least some of which are fitted with hoods that cover part of their faces and comprise orifices for blowing hot air mainly at right angles on to the sheet carried along by the cylinders.

It is well known how to pass wet sheet through a paper machine in loops between and over a number of heated rotating dryer cylinders, the sheet being pressed against the cylinder faces by an endless wire-screen belt, consisting of a loosely woven synthetic fiber cloth. The wire also facilitates the conveyance of the sheet from the wet end of the machine, where its strength is poor with an ensuing risk of breakage, to the dry end. The wire belt thus has two functions, viz., to support the forward travel of the wet sheet and to hold it in intimate contact with the dryer cylinders to increase the drying effect. As mentioned above, the wire is an endless rotating belt, forming a loop around terminal pulleys between adjacent cylinders. In high-speed paper machines there is a tendency to fluttering of the sheet at the unsupported transitions between rolls.

It is also a well-known technique to fit the dryer cylinders with hoods for blowing hot air streams at right angles on to the parts of the sheet that rest against the curved surfaces of the dryer cylinders. This causes a considerably improved drying effect, resulting in a shorter period of drying and an improved paper quality, owing to the uniform drying in each cross-section of the sheet. Hence the drying of a sheet that is carried entirely or to some extent by a wire, involves advantages as well as disadvantages. Among the advantages is the increase in strength prpendicularly to the sheet's surface, in tensile strength and modulus of elasticity of the paper; among the disadvantages, a certain reduction in gloss and stretch.

Further, it is well known how to dry a wet sheet without the aid of a wire belt by carrying the sheet by air or other medium and stabilizing it in a hovering position above the carrying surface by blowing air in two streams parallel to the travelling direction of the sheet, one stream in the direction of motion and the other stream in the opposite direction. This system of blower drying diminishes the above-mentioned disadvantages.

The present invention relates to a cylinder dryer, combining as far as possible in an optimum way the advantages of cylinder and blower drying without being impaired by the disadvantages associated with either of these systems.

SUMMARY OF THE INVENTION

This object is achieved according to the invention mainly by designing the hoods with extended wing members whose surfaces facing the wet sheet project parallel and in close proximity to the wet sheet that travels unsupported between adjacent cylinders, the said surfaces also being fitted with orifices for blowing streams of hot air parallel to the wet sheet in and opposite to its direction of motion.

The arrangement thus described enables a further reduction of the dryer-cylinder temperature to be made without impairing the desired drying effect. The gloss of the paper will be preserved and by choosing to let the sheet be supported in its entirety or in part by a wire belt it will also be possible to attain the desired mechanical-strength properties. It should be pointed out, however, that the sheet may well be passed through the dryers without a wire support, an arrangement that can be realized only in accordance with the present invention. By fitting both the upper and lower row of cylinders with hoods with extended wing members the unsupported stretch between adjacent cylinders, i.e., the part of the sheet that does not rest against the curved surface of a dryer cylinder, can be guided and stabilized by the extended wing members' being directed towards each other so that their blowing surfaces assume alternate positions on both sides of the wet sheet travelling without support between adjacent cylinders. This arrangement facilitates high-grade stabilization of the sheet during its transfer from one cylinder to another. The stream of air perpendicularly on to the sheet travelling around the dryer cylinders locates the sheet relative to the cylinders and presses it against their curved surfaces. It may, hence, be of considerable importance in certain cases that the wet sheet can traverse at least the first part of the dryer section without the support of a wire. As a result, in addition to the advantage of the increased paper gloss as mentioned previously, the risk of sheet rupture through contact with the wire-belt splice is eliminated in the very part of the dryer where the mechanical strength of the sheet is minimum and, consequently, the probability of rupture is maximum. After travelling a certain distance through the dryer, the sheet attains a degree of dryness that enables it to proceed without a wire support, and hence to arrive at the desired properties, such as mechanical strength.

BRIEF DESCRIPTION OF THE DRAWINGS

FIG. 1 shows a cylinder hood with extended wing members in accordance with the invention;

FIG. 1*a* shows a detail of a portion of the apparatus of FIG. 1;

DETAILED DESCRIPTION OF THE INVENTION

Figure 2:
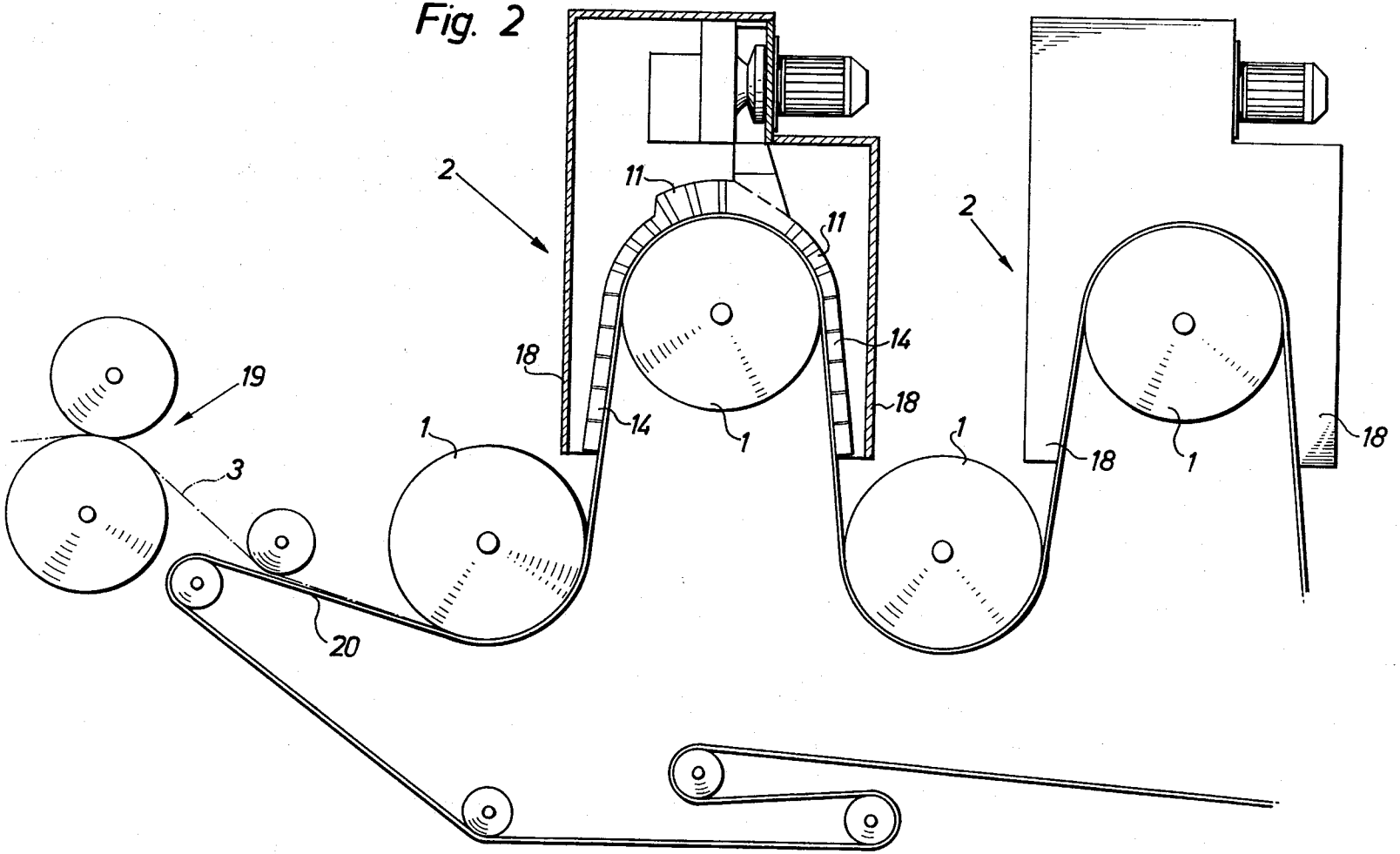
FIG. 2 illustrates the transfer of a wet sheet from the wet end to the dry end of a paper machine, the sheet being supported by a wire belt and the upper line of dryer cylinders being fitted with hoods in accordance with the invention.

The dryer cylinder 1 depicted in FIG. 1 comprises a cylinder hood 2 for blowing hot air on to a wet sheet 3. The hood 2 forms a chamber with outer walls 4, containing a centrifugal blower 6 driven by a motor 5. The chamber also contains a hot-air assembly 7 for heating the air that is circulated in the chamber by the blower 6. Intermediate partitions divide the chamber into a pressure compartment 8 that is connected to the blower outlet, and a suction compartment 9 connected to the blower inlet side. Following heating in the heater assembly 7, the air is pressurized in the blower 6 and subsequently flows into a distribution duct and then to blowing compartments 11 that are arranged around the curved surface of the cylinder and adjusted to the pressure drop at various distances from the distribution duct 10. From the blowing compartments 11 the pressurized hot air flows through orifices 12 perpendicularly on to the sheet 3 and is then removed by suction through return pipes 13. The flow of return air through these pipes 13 exerts a strong suction effect on the sheet 3, which is prevented from adhering to the pipes by incorporation of blowing pipes 19 in the centers of those return pipes 13 that have the largest diameter. Approximately from the points where the contact between the sheet 3 and cylinder 1 is broken and along a certain stretch in the direction of the sheet the hoods 2 are extended, the extended wing members 18 containing additional blowing compartments 14 which, however, are provided with orifices 15 for blowing hot air parallel to the sheet 3 in and opposite to the direction of sheet travel. One example of the design of these orifices can be seen in FIG. 1*a*, in which the orifices 15 are designed as so-called eyelid perforations. The additional blowing compartments 14 are also provided with orifices 16 for blowing air perpendicularly on to the wet sheet.

In the cylinder-dryer section shown in FIG. 2 the wet sheet by passing between press rolls 19 is transferred from the wet end of the machine to its dry end, in which the sheet is supported by a wire 20 in the form of an endless belt, which in this case follows the sheet around the dryer cylinders 1 in the dryer section. By this arrangement the wire 20 will press the sheet against the dryer cylinders 1 in the lower line of cylinders whereas it will be between the sheet 3 and the cylinders 1 in the upper line. The upper cylinders 1 are fitted with hoods 2 with extended wing members 18 in accordance with the invention, and the sheet when passing around the dryer cylinders is stabilized and pressed against the wire by means of the streams of air directed perpendicularly to the sheet. This arrangement to combines the advantages of using a wire belt and an airborne sheet. The wire stabilizes the sheet during its travel between the two lines of cylinders. This stabilization is further enhanced by the upper-line cylinder hoods with their extended wing members, which also increase the drying effect.

Figure 3:
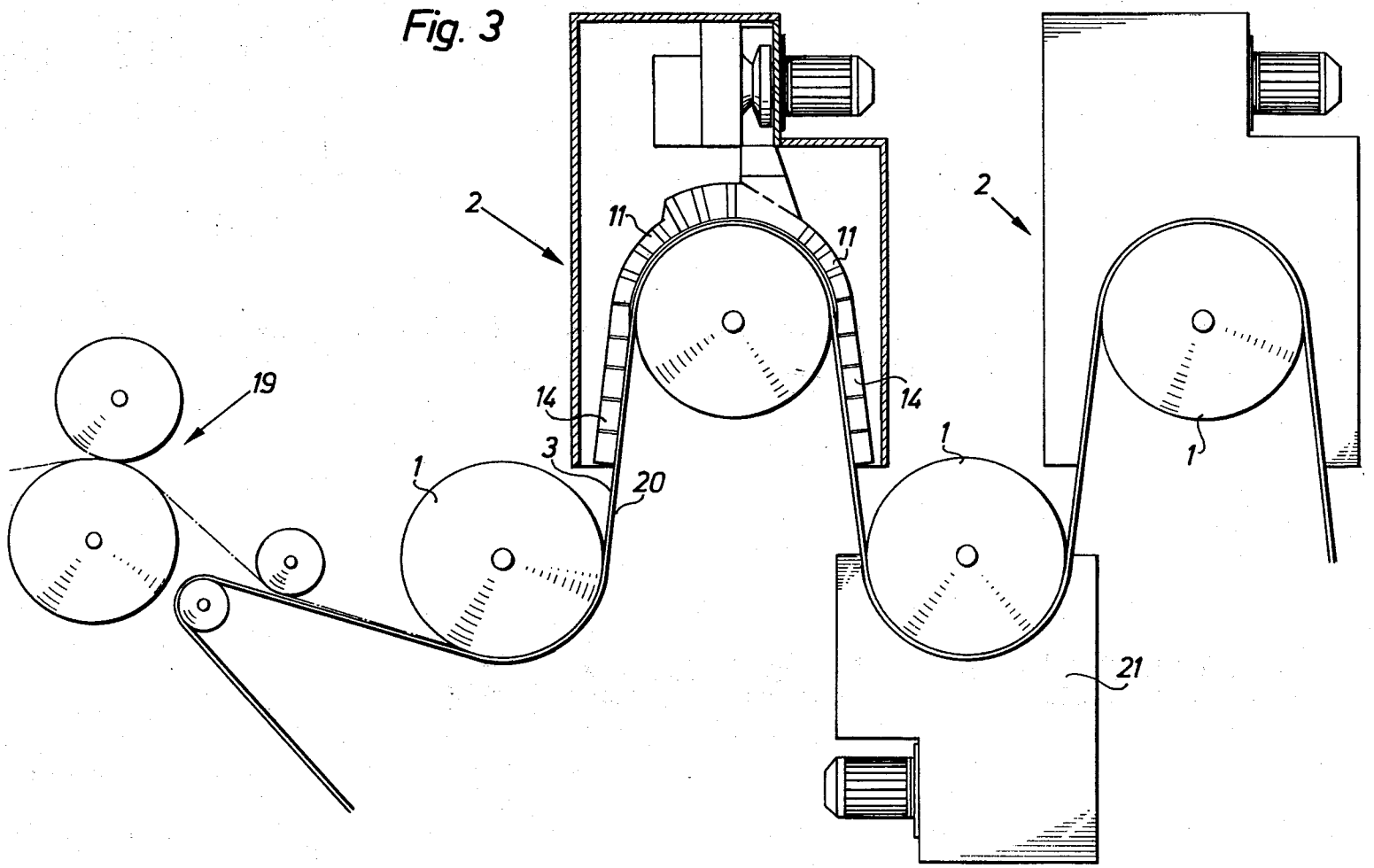
FIG. 3 demonstrates an arrangement similar to that in FIG. 2 but with some dryer cylinders in the lower line being fitted with conventional hoods for blowing air perpendicularly on to the sheet.

The dryer illustrated in FIG. 3 differs from the cylinder dryer according to FIG. 2 by having some of the lower-line cylinders fitted with conventional cylinder hoods 21 so designed as to enable hot air to be blown perpendicularly on to the travelling sheet. By this arrangement it is, naturally, possible to increase the drying effect while retaining the advantages from the dryers designed in accordance with FIG. 2.

Figure 4:
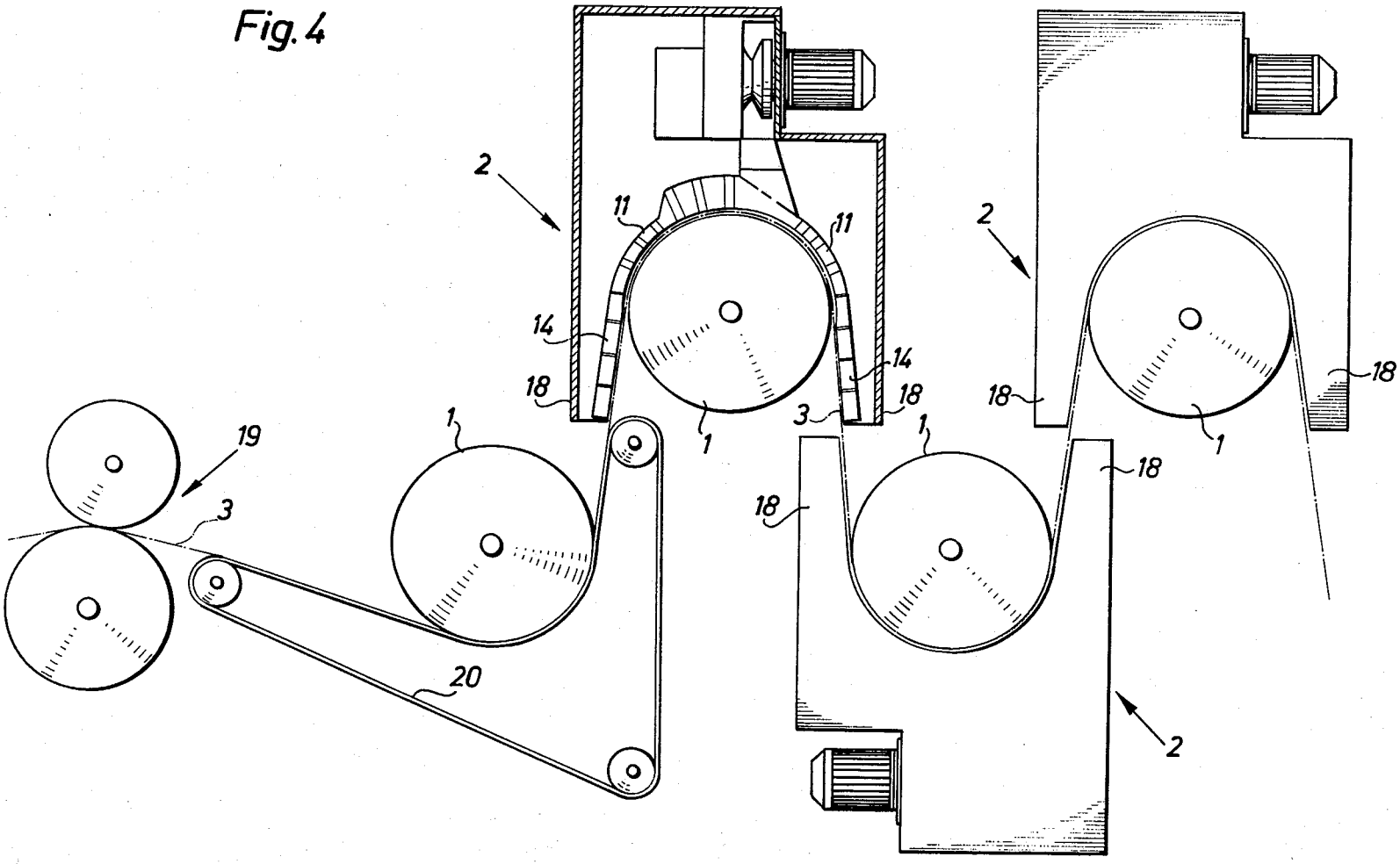
FIG. 4 shows an arrangement by which the wet sheet when entering the dry end is supported by a wire and then travels unsupported between cylinders that are surrounded by hoods in accordance with the invention.
Figure 5:
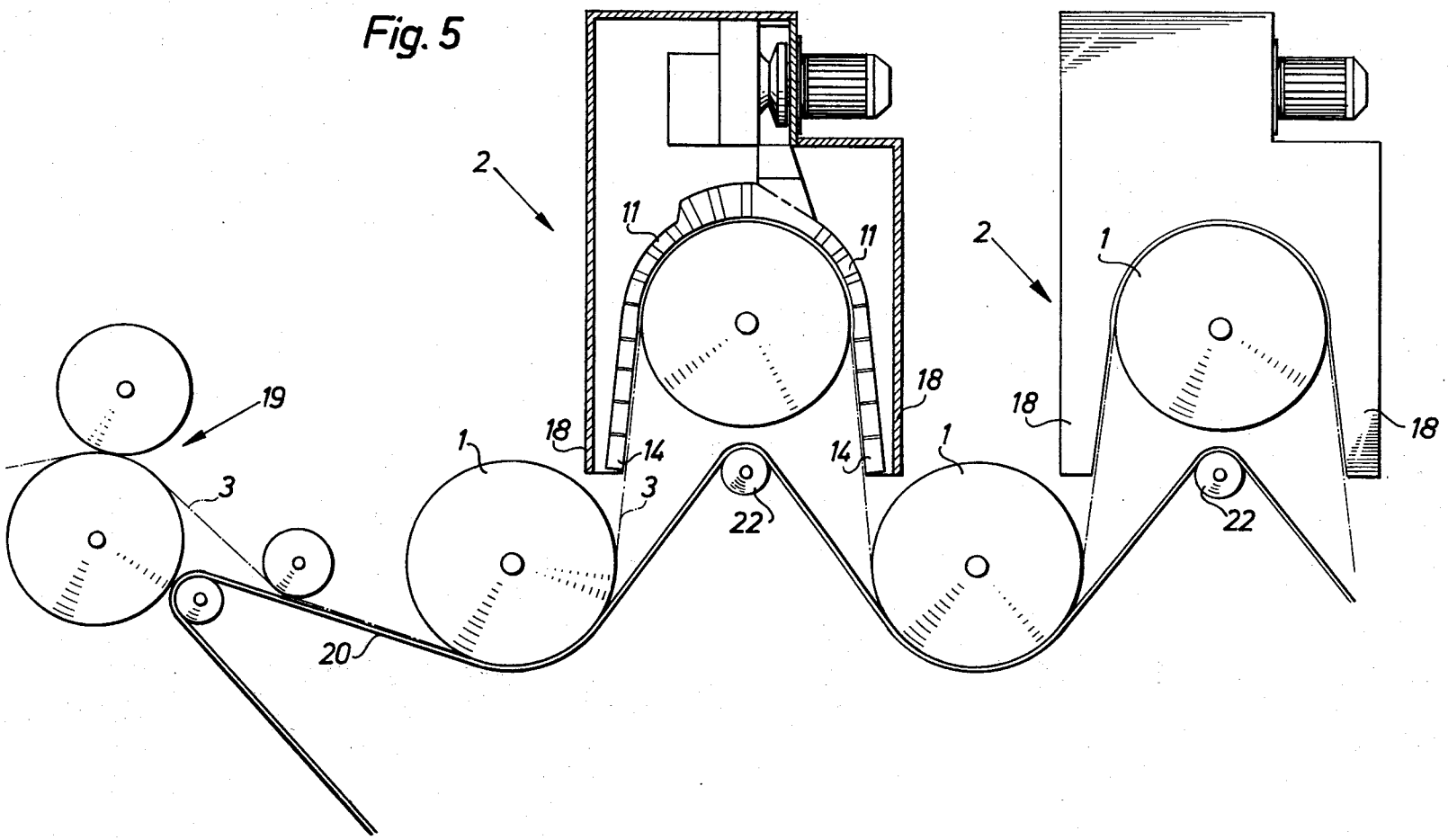
FIG. 5 illustrates an alternative embodiment of the dryer in which the sheet is supported by the wire at the conventionally designed cylinder dryers in the lower line while travelling without such support around the cylinders that have been fitted with hoods in accordance with the invention.

The dryer shown in FIG. 4 illustrates a further step towards an airborne and blower-dried sheet, the wire belt being eliminated in most phases of the drying process. In the dryer illustrated in FIG. 4, the wire 20 is only intended to support the sheet as it emerges from the press rolls 14 of the wet end until it enters the dryer over the first dryer cylinder 1, of conventional design. While travelling from this first lower-line dryer cylinder to the first upper-line cylinder the sheet is supported both by the wire and the extended wing member 18 of the upper hood. During its continued passage through the cylinder dryer the sheet then travels without wire support. This is rendered possible by attaching cylinder hoods 2 with extended wing members 18 both to the upper- and lower-line cylinders. While travelling between alternate cylinders the sheet is thus supported by means of the blowing compartments 14 that are arranged along its travelling path, heated air flowing from these compartments parallel to the sheet in and opposite to its direction of travel. Such an arrangement makes for high dryer efficiency. At the same time the blower drying system imparts valuable properties to the paper as the sheetis allowed to shrink freely. When reaching the curved surfaces of the dryer cylinders the sheet 3 is located relative to the cylinders by the streams of air operating perpendicularly to it, the said air streams also contributing to an improved heat transfer between the dryer cylinders and the sheet. After travelling along the curved surface of each cylinder to the point where it comes off, the sheet becomes stabilized by means of the blowing compartments in the extended wing members, which blow hot air in streams parallel to the sheet. The unsupported stretches of the sheet, i.e., the space between opposite wing ends in which it travels without support, are thus almost eliminated by the arrangement of FIG. 4. FIG. 5 illustrates a cylinder dryer that combines the features of a conventional dryer, in which the sheet is pressed against heated cylinders by a wire 20, and a blower dryer, in which an airborne sheet 3 travels around dryer cylinders 1. From the press rolls 19 terminating the wet end the sheet 3 is transferred to the dry end of the machine whereby it is supported by the wire 20 while passing around the first, conventionally heated dryer cylinder 1 in the lower line of cylinders. The wire 20 presses the sheet against part of the curved surface of each lower-line cylinder and then travels around idler rolls 22 that alternate with the cylinders in the lower line. The dryer cylinders in the upper line are fitted with hoods 2 with extended wing members 18 in accordance with the invention. When travelling through the unsupported stretches between alternate upper- and lower-line cylinders the sheet 3 is stabilized by means of the hot air flowing from the blowing compartments 14 parallel to, and in and opposite to, the direction of sheet travel. The advantages of the arrangement of FIG. 5 are to be found in the combination of paper properties that follow from blower drying in conjunction with wire-belt support and conventional dryer cylinders.

For all embodiments of the invention demonstrated in FIGS. 1 – 5 the hoods 2 may be so designed as to enable their displacement from and towards their appurtenant dryer cylinders, thus facilitating cleaning of the hoods and removal of paper caught in the hoods, for instance at ruptures of the sheet. The possibility of shifting the hoods is a particularly valuable feature as concerns the lower-line dryer cylinders since most of the sheet will accumulate in these hoods in case of sheet rupture.

I claim:

1. A cylinder dryer for drying a wet paper sheet and adapted to be incorporated in the first part of the dryer section of a paper machine, comprising:

a plurality of heated cylinders that are arranged at at least one upper and one lower level for receiving a travelling wet sheet thereon, the wet sheet during the drying process travelling in loops up and down around the cylinders of the upper and lower levels with portions of the wet sheet travelling between the cylinders being unsupported;

a source of blown hot air;

hoods provided for at least some of said heated cylinders, said hoods covering part of the curved surfaces of their respective heated cylinders, each of said hoods being coupled to said hot air source and having first orifice means arranged for blowing hot air at least substantially perpendicularly on to the sheet travelling from one cylinder to another;

the improvement wherein:

at least the hoods for the upper level heated cylinders have extended wing members whose surfaces facing the wet sheet extend along at least a substantial portion of said wet sheet that travels unsupported by, and between, alternate heated cylinders, said wing members projecting substantially parallel and in close proximity to said unsupported portions of said wet sheet; and said surfaces of said extended wing members have second orifices arranged for blowing streams of hot air substantially parallel to said unsupported portions of said wet sheet in both the same direction as its direction of travel and opposite to its direction of travel for stabilizing the said sheet.

2. A cylinder dryer according to claim 1, wherein the heated cylinders are arranged at upper and lower cylinder levels which are substantially horizontal and substantially parallel to each other, and further comprising a travelling wire belt for at least partially supporting said sheet during its travel through the dryer.

3. A cylinder dryer according to claim 2, wherein said wire belt is arranged to support said sheet in its entirety during its travel through the dryer.

4. A cylinder dryer according to claim 2, wherein the lower level includes a plurality of heated cylinders and wherein the cylinder hoods on the lower level heated cylinders comprise orifices for blowing hot air only substantially perpendicularly on to the wet sheet.

5. A cylinder dryer according to claim 2, wherein said hoods for said heated cylinders on the upper as well as at least one on the lower level have said extended wing members, said extended wing members of the hoods for the upper and lower level cylinders being directed towards each other with their stabilizing blowing surfaces being situated on opposite sides of the wet sheet travelling unsupported by, and between, alternate cylinders.

6. A cylinder dryer according to claim 1, wherein the cylinder hoods on the lower level heated cylinders comprise orifices for blowing hot air only substantially perpendicularly on to the wet sheet.

7. A cylinder dryer according to claim 1, wherein said hoods for said heated cylinders on the upper as well as at least one on the lower level have said extended wing members, said extended wing members of the hoods for the upper and lower level cylinders being directed towards each other with their stabilizing blowing surfaces being situated on opposite sides of the wet sheet travelling unsupported by, and between, alternate cylinders.

8. A cylinder dryer according to claim 1, wherein said extended wing members have further orifices for additionally blowing streams of hot air substantially perpendicular to the sheet.

9. A cylinder dryer according to claim 1, wherein the portions of said hoods covering the curved surfaces of their respective heated cylinders comprise a plurality of blowing compartments having said orifices therein for blowing hot air substantially perpendicularly on to the sheet, and a plurality of return pipe means for flowing the air away from said hood.

10. A cylinder dryer according to claim 9, wherein said return pipe means each have supplemental blowing pipes therein for blowing heated air toward the sheet, to prevent exertion of a strong suction effect on the sheet.

11. A cylinder dryer according to claim 1, wherein said extended wing members comprise a plurality of compartments, each of said compartments having said orifices for blowing streams of hot air substantially parallel to said sheet in and opposite to its direction of travel for stabilizing said sheet.

12. A cylinder dryer according to claim 11, wherein each of said compartments further comprise at least one orifice for blowing streams of hot air substantially perpendicular to said sheet.

13. A cylinder dryer according to claim 1 wherein only the hoods for the upper level heated cylinders are provided with said extended wing members with said orifices for blowing streams of hot air.

14. A cylinder dryer according to claim 13 wherein only the upper level heated cylinders are provided with said hoods.

* * * * *